US010056696B2

(12) United States Patent
Tseng et al.

(10) Patent No.: US 10,056,696 B2
(45) Date of Patent: Aug. 21, 2018

(54) ANTENNA STRUCTURE

(71) Applicant: Wistron NeWeb Corp., Hsinchu (TW)

(72) Inventors: Shih-Hsien Tseng, Hsinchu (TW); Chia-Hao Chang, Hsinchu (TW); Yu-Sheng Fan, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 71 days.

(21) Appl. No.: 15/361,243

(22) Filed: Nov. 25, 2016

(65) Prior Publication Data

US 2017/0207542 A1 Jul. 20, 2017

Related U.S. Application Data

(60) Provisional application No. 62/278,668, filed on Jan. 14, 2016.

(51) Int. Cl.

| | |
|---|---|
| ***H01Q 13/10*** | (2006.01) |
| ***H01Q 1/24*** | (2006.01) |
| ***H01Q 1/36*** | (2006.01) |
| ***H01Q 1/48*** | (2006.01) |
| ***H01Q 5/357*** | (2015.01) |

(52) U.S. Cl.

CPC ..... *H01Q 13/106* (2013.01); *H01Q 1/243* (2013.01); *H01Q 1/36* (2013.01); *H01Q 1/48* (2013.01); *H01Q 5/357* (2015.01); *H01Q 13/10* (2013.01)

(58) Field of Classification Search

CPC ..... H01Q 5/357; H01Q 13/10; H01Q 13/106

See application file for complete search history.

(56) References Cited

U.S. PATENT DOCUMENTS

2017/0033467 A1* 2/2017 Huang ..... H01Q 13/106

* cited by examiner

*Primary Examiner* — Graham Smith

(74) *Attorney, Agent, or Firm* — McClure, Qualey & Rodack, LLP

(57) ABSTRACT

An antenna structure includes a metal piece, a dielectric substrate, a feeding radiation element, a grounding radiation element, and a grounding metal element. The metal piece has a slot. A lower surface of the dielectric substrate is adjacent to the slot of the metal piece. The feeding radiation element is disposed on an upper surface of the dielectric substrate, and is coupled to a positive electrode of a signal source. The grounding radiation element is disposed on the upper surface of the dielectric substrate, and is coupled to a negative electrode of the signal source. The grounding radiation element is coupled through the grounding metal element to the metal piece. At least one of the feeding radiation element and the grounding radiation element has a vertical projection which at least partially overlaps the slot of the metal piece.

17 Claims, 8 Drawing Sheets

ANTENNA STRUCTURE

CROSS REFERENCE TO RELATED APPLICATIONS

This application claims the benefit of U.S. Provisional Application No. 62/278,668, filed on Jan. 14, 2016, the entirety of which is incorporated by reference herein.

BACKGROUND OF THE INVENTION

Field of the Invention

The disclosure generally relates to an antenna structure, and more particularly, to a wideband antenna structure.

Description of the Related Art

With advancements in mobile communication technology, mobile devices such as portable computers, mobile phones, multimedia players, and other hybrid functional portable electronic devices have become more common. To satisfy consumer demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna for signal reception and transmission has insufficient bandwidth, it will degrade the communication quality of the relative mobile device. Accordingly, it has become a critical challenge for antenna designers to design a small-size, wideband antenna element.

SUMMARY OF THE INVENTION

In an exemplary embodiment, the disclosure is directed to an antenna structure including a metal piece, a dielectric substrate, a feeding radiation element, a grounding radiation element, and a grounding metal element. The metal piece has a slot. The dielectric substrate has an upper surface and a lower surface. The lower surface of the dielectric substrate is adjacent to the slot of the metal piece. The feeding radiation element is disposed on the upper surface of the dielectric substrate, and is coupled to a positive electrode of a signal source. The grounding radiation element is disposed on the upper surface of the dielectric substrate, and is coupled to a negative electrode of the signal source. The grounding radiation element is coupled through the grounding metal element to the metal piece. At least one of the feeding radiation element and the grounding radiation element has a vertical projection which at least partially overlaps the slot of the metal piece.

In some embodiments, the antenna structure operates in a low-frequency band from about 2400 MHz to about 2484 MHz, and a high-frequency band from about 5150 MHz to about 5850 MHz.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
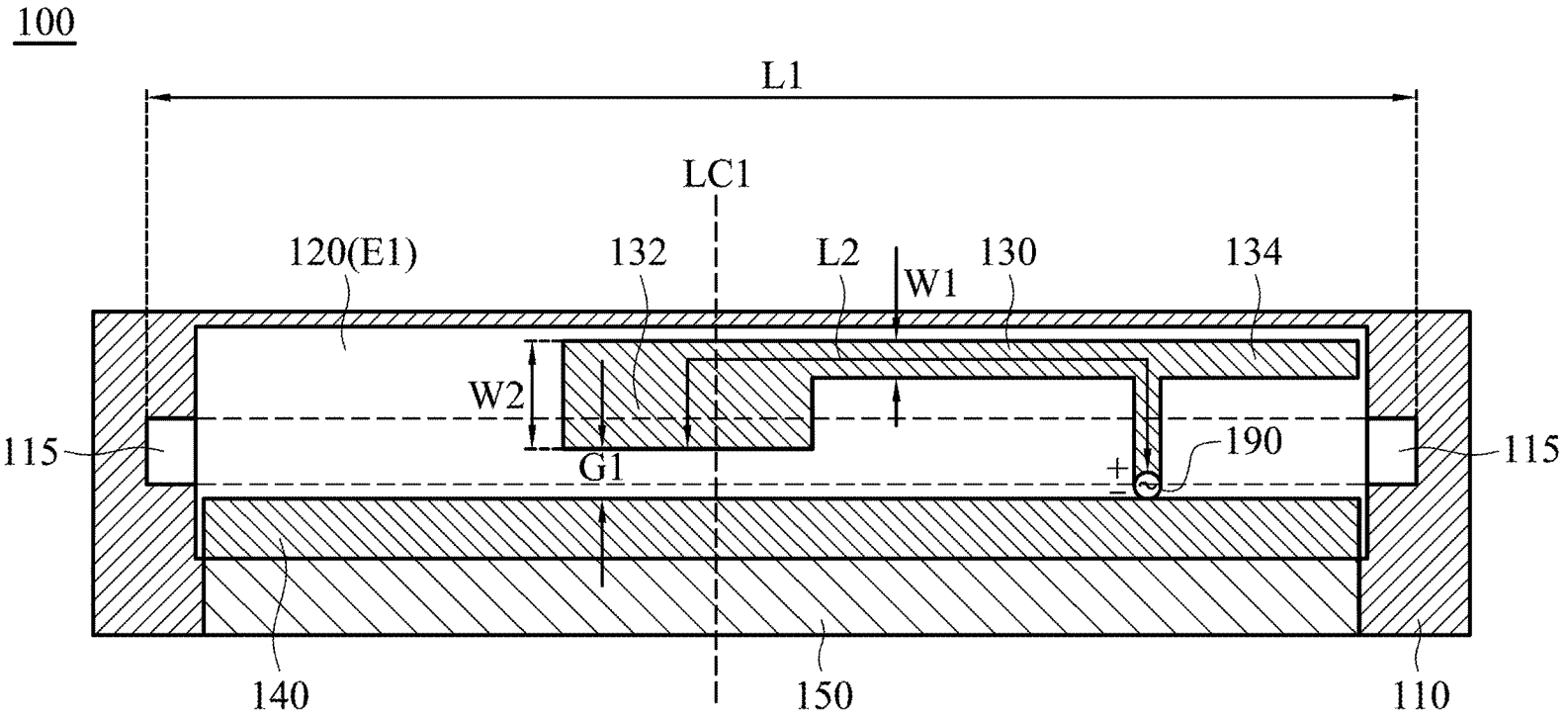
FIG. 1A is a top view of an antenna structure according to an embodiment of the invention.
Figure 1B:
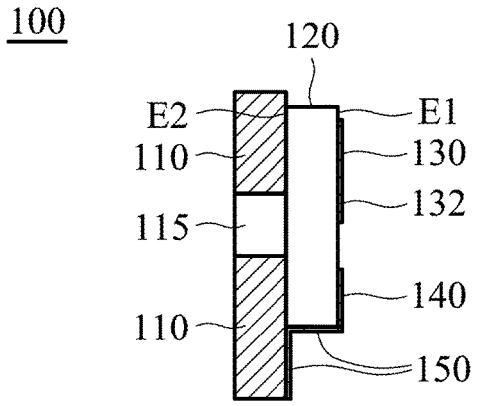
FIG. 1B is a sectional view of an antenna structure according to an embodiment of the invention.

FIG. 1A is a top view of an antenna structure 100 according to an embodiment of the invention. FIG. 1B is a sectional view of the antenna structure 100 according to an embodiment of the invention (along to a section line LC1 of FIG. 1A). Please refer to FIG. Please refer to FIG. 1A together with FIG. 1B. The antenna structure 100 may be applied in a mobile device, such as a smartphone, a tablet computer, or a notebook computer. As shown in FIG. 1A and FIG. 1B, the antenna structure 100 includes a metal piece 110, a dielectric substrate 120, a feeding radiation element 130, a grounding radiation element 140, and a grounding metal element 150. The feeding radiation element 130 and the grounding radiation element 140 may be made of metal materials, such as copper, silver, aluminum, iron, or their alloys.

The metal piece 110 may be a metal housing of a mobile device, such as an entire metal back cover. In some embodiments, the metal piece 110 is the metal upper cover of a notebook computer. The metal piece 110 has a slot 115. The slot 115 of the metal piece 110 may be substantially a straight-line shape. The dielectric substrate 120 may be an FR4 (Flame Retardant 4) substrate or an FPCB (Flexible Printed Circuit Board). The dielectric substrate 120 has an upper surface E1 and a lower surface E2. The lower surface E2 of the dielectric substrate 120 is adjacent to the slot 115 of the metal piece 110. Specifically, the lower surface E2 of the dielectric substrate 120 may be attached to the metal piece 110, and the dielectric substrate 120 may extend across the slot 115 of the metal piece 110. The feeding radiation element 130 is disposed on the upper surface E1 of the dielectric substrate 120, and is coupled to a positive electrode of a signal source 190. The signal source 190 may be an RF (Radio Frequency) module for exciting the antenna structure 100. The grounding radiation element 140 is also disposed on the upper surface E1 of the dielectric substrate 120, and is coupled to a negative electrode of the signal source 190. The feeding radiation element 130 and the grounding radiation element 140 may be completely separate from each other. The grounding metal element 150 may be a ground copper foil. The grounding metal element 150 may be substantially a stepped shape, for example the grounding radiation element 140 may be coupled through the grounding metal element 150 to the metal piece 110. For example, the grounding radiation element 140 and the metal piece 110 may be disposed on two respective parallel planes, and the grounding metal element 150 may be electrically connected the grounding radiation element 140 with the metal piece 110.

At least one of the feeding radiation element 130 and the grounding radiation element 140 has a vertical projection which at least partially overlaps the slot 115 of the metal piece 110. For example, the feeding radiation element 130 may have a projection on the metal piece 110, and the projection may be the aforementioned vertical projection. Alternatively, the grounding radiation element 140 may have a projection on the metal piece 110, and the projection may be the aforementioned vertical projection. In the embodiment of FIG. 1A and FIG. 1B, the feeding radiation element 130 is substantially a T-shape, and the grounding radiation element 140 is substantially a straight-line shape. The feeding radiation element 130 further includes a terminal rectangular widening portion 132. The width W2 of the terminal rectangular widening portion 132 is larger than the width W1 of the other portion of the feeding radiation element 130. The terminal rectangular widening portion 132 of the feeding radiation element 130 has a vertical projection which at least partially overlaps the slot 115 of the metal piece 110. For example, the terminal rectangular widening portion 132 of the feeding radiation element 130 may extend to a half of the width of the slot 115 of the metal piece 110. The feeding radiation element 130 may further include a tuning branch 134. The terminal rectangular widening portion 132 and the tuning branch 134 of the feeding radiation element 130 may substantially extend toward opposite directions. The tuning branch 134 is an optional element, and it may substantially be a straight-line shape and configured to adjust the impedance matching of the antenna structure 100. In another embodiment, the tuning branch 134 is omitted, such that the feeding radiation element 130 is substantially an L-shape. There is a gap G1 between the terminal rectangular widening portion 132 of the feeding radiation element 130 and the grounding radiation element 140. The width of the gap G1 is larger than 0 mm. The antenna structure 100 mainly uses the feeding radiation element 130 to excite the slot 115 of the metal piece 110 by coupling.

Figure 2:
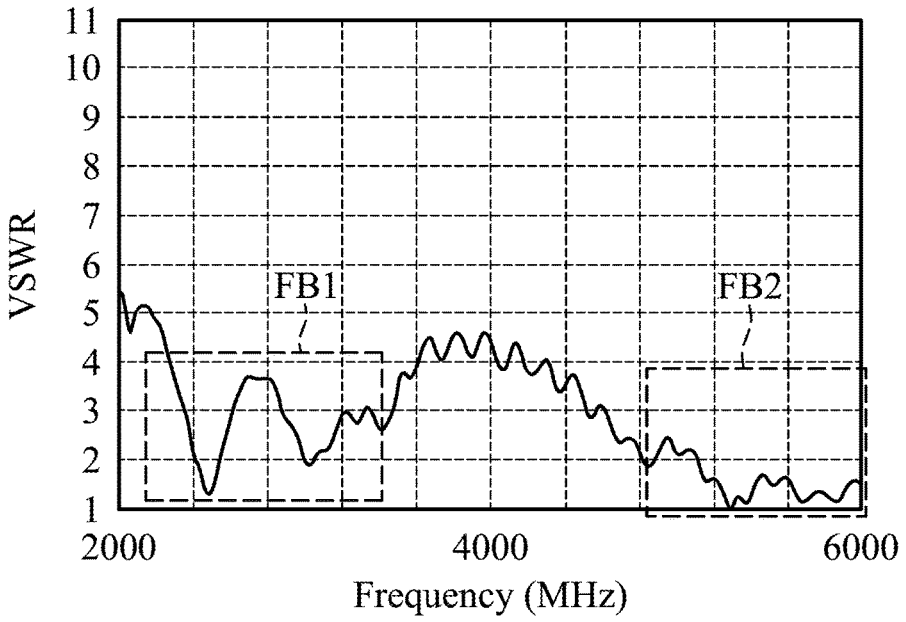
FIG. 2 is a diagram of a VSWR (Voltage Standing Wave Ratio) of an antenna structure according to an embodiment of the invention.

FIG. 2 is a diagram of a VSWR (Voltage Standing Wave Ratio) of the antenna structure 100 according to an embodiment of the invention. The vertical axis represents the operation frequency (MHz), and the horizontal axis represents the VSWR. According to the measurement of FIG. 2, the antenna structure 100 can cover a low-frequency band FB1 from about 2400 MHz to about 2484 MHz, and a high-frequency band FB2 from about 5150 MHz to about 5850 MHz. Therefore, the antenna structure 100 can support dual-band operations of WLAN (Wireless Local Area Network) 2.4 GHz/5 GHz. According to practical measurement results, the average antenna gain of the antenna structure 100 is about −3.6 dB in the low-frequency band FB1, and is about −4.6 dB in the high-frequency band FB2. Such antenna gain can meet the requirements of practical application of general mobile communication devices.

Please refer to FIG. 1A, FIG. 1B, and FIG. 2 to understand the operation principle and element sizes of the antenna structure 100. The slot 115 of the metal piece 110 is excited to generate a fundamental resonant mode, thereby forming the low-frequency band FB1. The length L1 of the slot 115 of the metal piece 110 may be substantially equal to 0.5 wavelength (λ/2) of the low-frequency band FB1. The feeding radiation element 130 is excited to generate a resonant mode, thereby forming the high-frequency band FB2. The length L2 of the feeding radiation element 130 (the length L2 is from the positive electrode of the signal source 190 to the open end of the terminal rectangular widening portion 132, but it does not include the tuning branch 134) may be substantially equal to 0.25 wavelength (λ/4) of the high-frequency band FB2. The slot 115 of the metal piece 110 may be further excited to generate a higher-order resonant mode, thereby widening the high-frequency band FB2. With such a design, the metal piece 110 is considered as an extension portion of the antenna structure 100, and therefore it does not negatively affect the radiation performance of the antenna structure 100. Furthermore, the feeding radiation element 130 has a vertical projection which at least partially overlaps the slot 115 of the metal piece 110. This helps to minimize the total size of the antenna structure 100 and increase the operation bandwidth of the antenna structure 100. Accordingly, the antenna structure 100 has the advantages of miniaturizing the size and widening the bandwidth, and it is suitable for application in a variety of mobile communication devices with whole metal back covers.

Figure 3A:
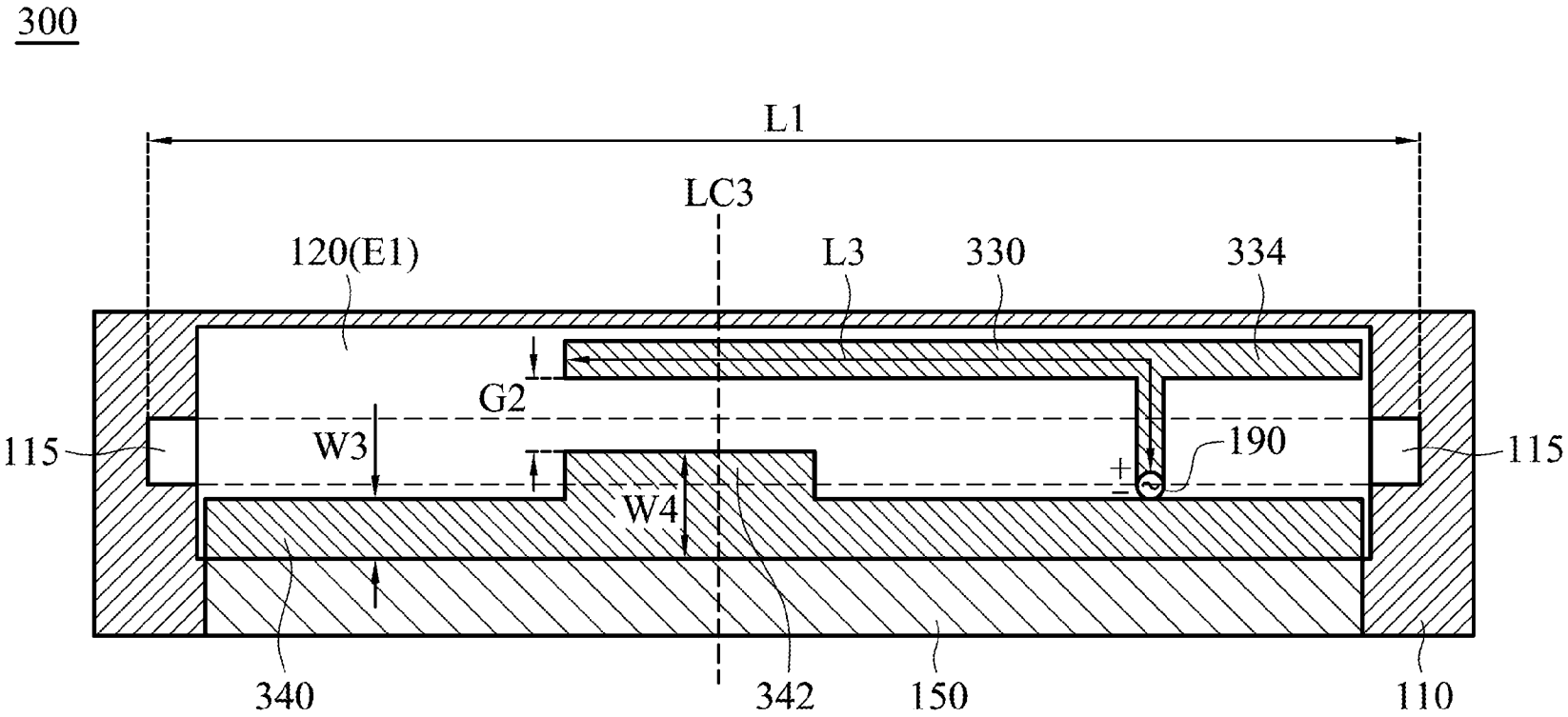
FIG. 3A is a top view of an antenna structure according to an embodiment of the invention.
Figure 3B:
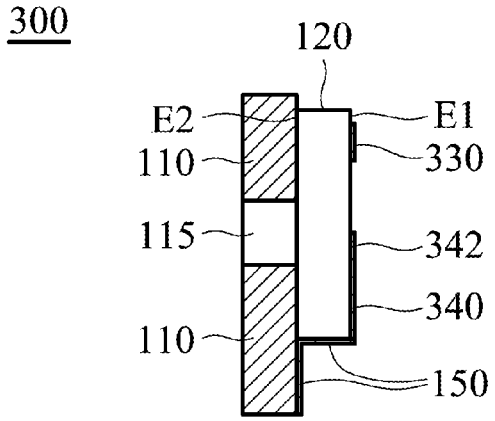
FIG. 3B is a sectional view of an antenna structure according to an embodiment of the invention.

FIG. 3A is a top view of an antenna structure 300 according to an embodiment of the invention. FIG. 3B is a sectional view of the antenna structure 300 according to an embodiment of the invention (along to a section line LC3 of FIG. 3A). Please refer to FIG. 3A and FIG. 3B together. FIG. 3A and FIG. 3B are similar to FIG. 1A and FIG. 1B. In the embodiment of FIG. 3A and FIG. 3B, a feeding radiation element 330 and a grounding radiation element 340 of the antenna structure 300 have different structures and different shapes. The feeding radiation element 330 may be substantially a T-shape, and the grounding radiation element 340 may be substantially an inverted T-shape. The feeding radiation element 330 does not include any terminal rectangular widening portion. The grounding radiation element 340 further includes a protruding portion 342. The width W4 of the protruding portion 342 is larger than the width W3 of the other portion of the grounding radiation element 340. The protruding portion 342 of the grounding radiation element 340 has a vertical projection which at least partially overlaps the slot 115 of the metal piece 110. For example, the protruding portion 342 of the grounding radiation element 340 may extend to a half of the width of the slot 115 of the metal piece 110. The feeding radiation element 330 may further include a tuning branch 334. The tuning branch 334 is an optional element, and it may be substantially a straight-line shape and be configured to adjust the impedance matching of the antenna structure 300. In another embodiment, the tuning branch 334 is omitted, such that the feeding radiation element 330 would be substantially an L-shape. There is a gap G2 between the feeding radiation element 330 and the protruding portion 342 of the grounding radiation element 340. The width of the gap G2 is larger than 0 mm. The antenna structure 300 mainly uses the grounding radiation element 340 to excite the slot 115 of the metal piece 110 by coupling. Other features of the antenna structure 300 of FIG. 3A and FIG. 3B are similar to those of the antenna structure 100 of FIG. 1A and FIG. 1B. Accordingly, the two embodiments can achieve similar levels of performance.

Figure 4:
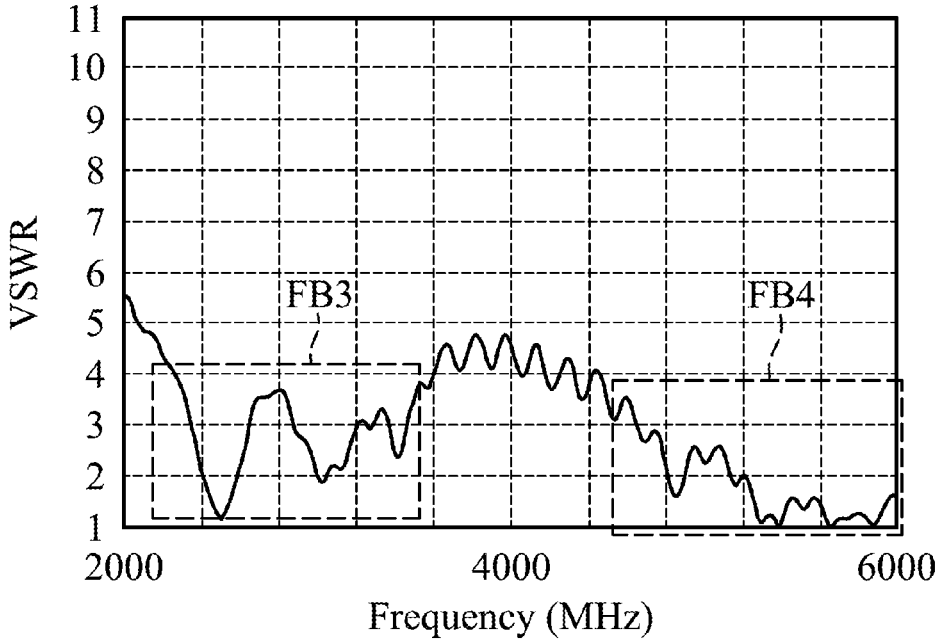
FIG. 4 is a diagram of a VSWR of an antenna structure according to an embodiment of the invention.

FIG. 4 is a diagram of a VSWR (Voltage Standing Wave Ratio) of the antenna structure 300 according to an embodiment of the invention. The vertical axis represents the operation frequency (MHz), and the horizontal axis represents the VSWR. According to the measurement of FIG. 4, the antenna structure 300 can cover a low-frequency band FB3 from about 2400 MHz to about 2484 MHz, and a high-frequency band FB4 from about 5150 MHz to about 5850 MHz. Therefore, the antenna structure 300 can support dual-band operations of WLAN (Wireless Local Area Network) 2.4 GHz/5 GHz. According to practical measurement results, the average antenna gain of the antenna structure 300 is about −3.6 dB in the low-frequency band FB3, and is about −4.6 dB in the high-frequency band FB4. Such antenna gain can meet the requirements of practical application of general mobile communication devices.

Please refer to FIG. 3A, FIG. 3B, and FIG. 4 to understand the operation principle and element sizes of the antenna structure 300. The slot 115 of the metal piece 110 is excited to generate a fundamental resonant mode, thereby forming the low-frequency band FB3. The length L1 of the slot 115 of the metal piece 110 may be substantially equal to 0.5 wavelength (212) of the low-frequency band FB3. The feeding radiation element 330 is excited to generate a resonant mode, thereby forming the high-frequency band FB4. The length L3 of the feeding radiation element 330 (the length L3 is from the positive electrode of the signal source 190 to the left open end of the feeding radiation element 330, but it does not include the tuning branch 334) may be substantially equal to 0.25 wavelength (λ/4) of the high-frequency band FB4. The slot 115 of the metal piece 110 may be further excited to generate a higher-order resonant mode, thereby widening the high-frequency band FB4.

Figure 5A:
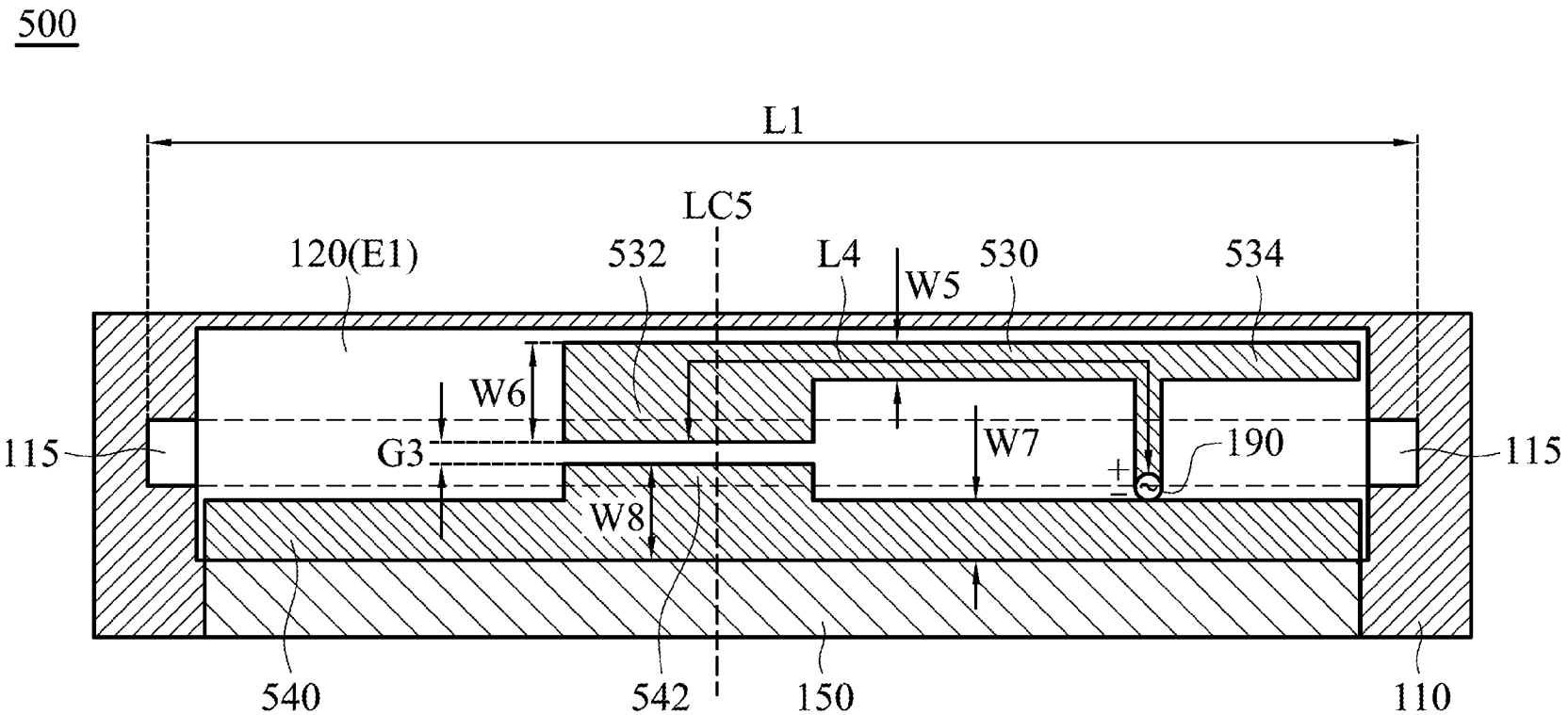
FIG. 5A is a top view of an antenna structure according to an embodiment of the invention.
Figure 5B:
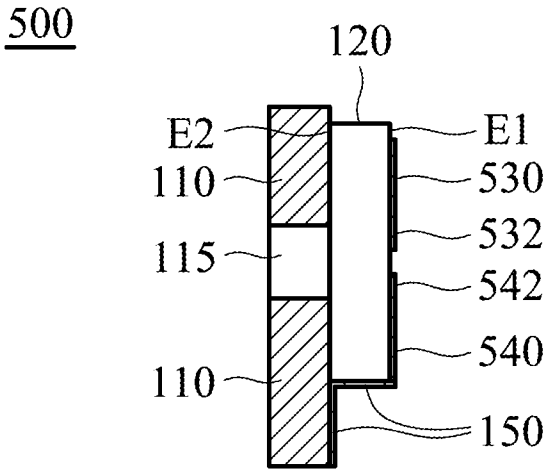
FIG. 5B is a sectional view of an antenna structure according to an embodiment of the invention.

FIG. 5A is a top view of an antenna structure 500 according to an embodiment of the invention. FIG. 5B is a sectional view of the antenna structure 500 according to an embodiment of the invention (along to a section line LC5 of FIG. 5A). Please refer to FIG. 5A and FIG. 5B together. FIG. 5A and FIG. 5B are similar to FIG. 1A and FIG. 1B. In the embodiment of FIG. 5A and FIG. 5B, a feeding radiation element 530 and a grounding radiation element 540 of the antenna structure 500 have different structures and different shapes. The feeding radiation element 530 may be substantially a T-shape, and the grounding radiation element 540 may be substantially an inverted T-shape. The feeding radiation element 530 further includes a terminal rectangular widening portion 532. The width W6 of the terminal rectangular widening portion 532 is larger than the width W5 of the other portion of the feeding radiation element 530. The terminal rectangular widening portion 532 of the feeding radiation element 530 has a vertical projection which at least partially overlaps the slot 115 of the metal piece 110. For example, the terminal rectangular widening portion 532 of the feeding radiation element 530 may extend to one-third of the width of the slot 115 of the metal piece 110. The feeding radiation element 530 may further include a tuning branch 534. The terminal rectangular widening portion 532 and the tuning branch 534 of the feeding radiation element 530 may substantially extend in opposite directions. The tuning branch 534 is an optional element, and it may be substantially a straight-line shape and be configured to adjust the impedance matching of the antenna structure 500. In another embodiment, the tuning branch 534 is omitted, such that the feeding radiation element 530 is substantially an L-shape. The grounding radiation element 540 further includes a protruding portion 542. The width W8 of the protruding portion 542 is larger than the width W7 of the other portion of the grounding radiation element 540. The protruding portion 542 of the grounding radiation element 540 has a vertical projection which at least partially overlaps the slot 115 of the metal piece 110. For example, the protruding portion 542 of the grounding radiation element 540 may extend to one-third of the width of the slot 115 of the metal piece 110. There is a gap G3 between the terminal rectangular widening portion 532 of the feeding radiation element 530 and the protruding portion 542 of the grounding radiation element 540. The width of the gap G3 is larger than 0 mm. The antenna structure 500 mainly uses both the feeding radiation element 530 and the grounding radiation element 540 to excite the slot 115 of the metal piece 110 by coupling. Other features of the antenna structure 500 of FIG. 5A and FIG. 5B are similar to those of the antenna structure 100 of FIG. 1A and FIG. 1B. Accordingly, the two embodiments can achieve similar levels of performance.

The antenna structure 500 can cover a low-frequency band from about 2400 MHz to about 2484 MHz, and a high-frequency band from about 5150 MHz to about 5850 MHz. Therefore, the antenna structure 500 can support dual-band operations of WLAN (Wireless Local Area Network) 2.4 GHz/5 GHz. Please refer to FIG. 5A and FIG. 5B to understand the operation principle and element sizes of the antenna structure 500. The slot 115 of the metal piece 110 is excited to generate a fundamental resonant mode, thereby forming the low-frequency band. The length L1 of the slot 115 of the metal piece 110 may be substantially equal to 0.5 wavelength (λ/2) of the low-frequency band. The feeding radiation element 530 is excited to generate a resonant mode, thereby forming the high-frequency band. The length L4 of the feeding radiation element 530 (the length L4 is from the positive electrode of the signal source 190 to the open end of the terminal rectangular widening portion 532 of the feeding radiation element 530, but it does not include the tuning branch 534) may be substantially equal to 0.25 wavelength (λ/4) of the high-frequency band. The slot 115 of the metal piece 110 may be further excited to generate a higher-order resonant mode, thereby widening the high-frequency band.

Figure 6A:
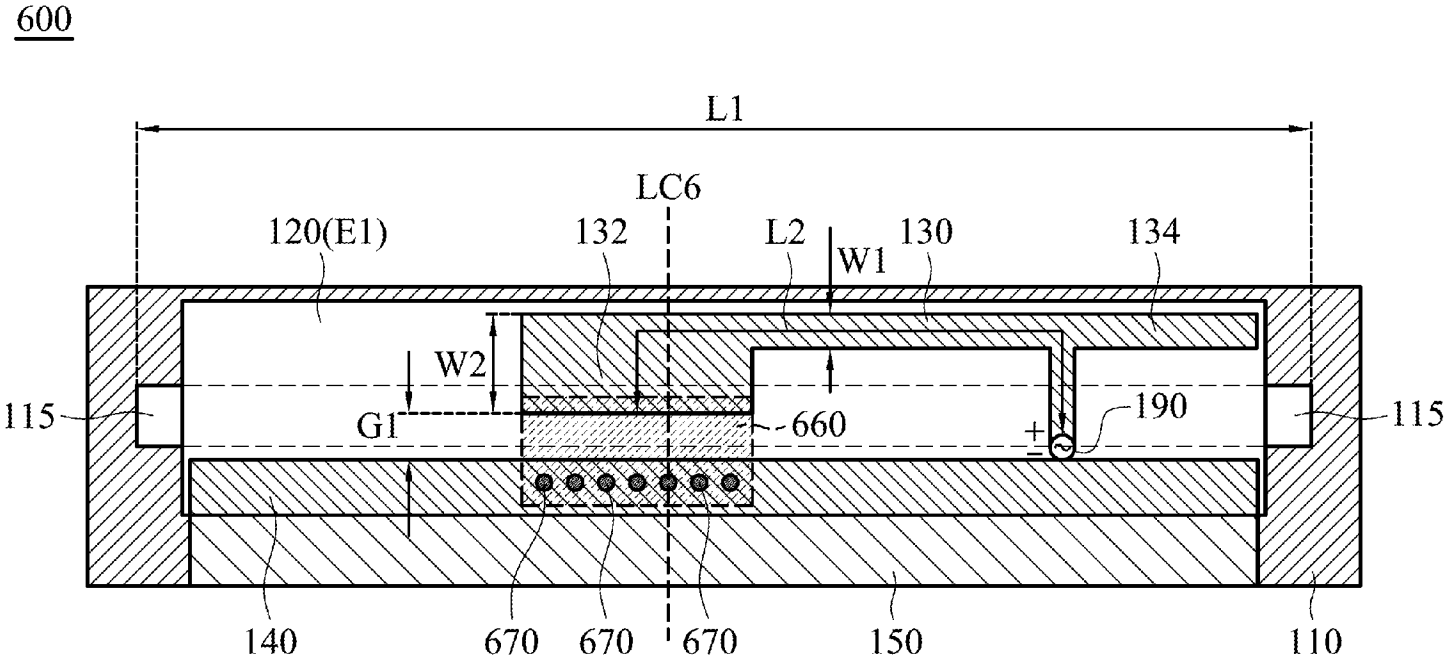
FIG. 6A is a top view of an antenna structure according to an embodiment of the invention.
Figure 6B:
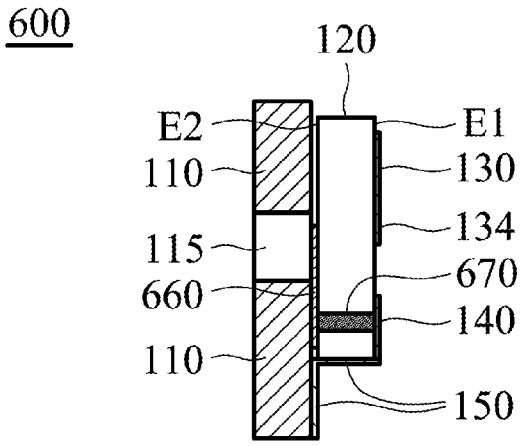
FIG. 6B is a sectional view of an antenna structure according to an embodiment of the invention.

FIG. 6A is a top view of an antenna structure 600 according to an embodiment of the invention. FIG. 6B is a sectional view of the antenna structure 600 according to an embodiment of the invention (along to a section line LC6 of FIG. 6A). Please refer to FIG. 6A and FIG. 6B together. FIG. 6A and FIG. 6B are similar to FIG. 1A and FIG. 1B. In the embodiment of FIG. 6A and FIG. 6B, the antenna structure 600 further includes a coupling radiation element 660 and one or more via elements 670. The coupling radiation element 660 and the via elements 670 are made of metal materials, such as copper, silver, aluminum, iron, or their alloys. The coupling radiation element 660 may be substantially a rectangular shape. Each of the via elements 670 may be substantially a pillar shape and be formed in the dielectric substrate 120. The coupling radiation element 660 is disposed on the lower surface E2 of the dielectric substrate 120, and is coupled through the via elements 670 to the grounding radiation element 140. The coupling radiation element 660 is completely separate from the feeding radiation element 130. The coupling radiation element 660 has a vertical projection which at least partially overlaps the slot 115 of the metal piece 110. In some embodiments, the vertical projection of the coupling radiation element 660 at least partially overlaps the terminal rectangular widening portion 132 of the feeding radiation element 130. In some embodiments, the shape and size of the coupling radiation element 660 are substantially the same as the shape and size of the terminal rectangular widening portion 132 of the feeding radiation element 130. The existence of the coupling radiation element 660 helps to enhance the mutual coupling between the feeding radiation element 130 and the slot 115 of the metal piece 110. Other features of the antenna structure 600 of FIG. 6A and FIG. 6B are similar to those of the antenna structure 100 of FIG. 1A and FIG. 1B. Accordingly, the two embodiments can achieve similar levels of performance.

Figure 7:
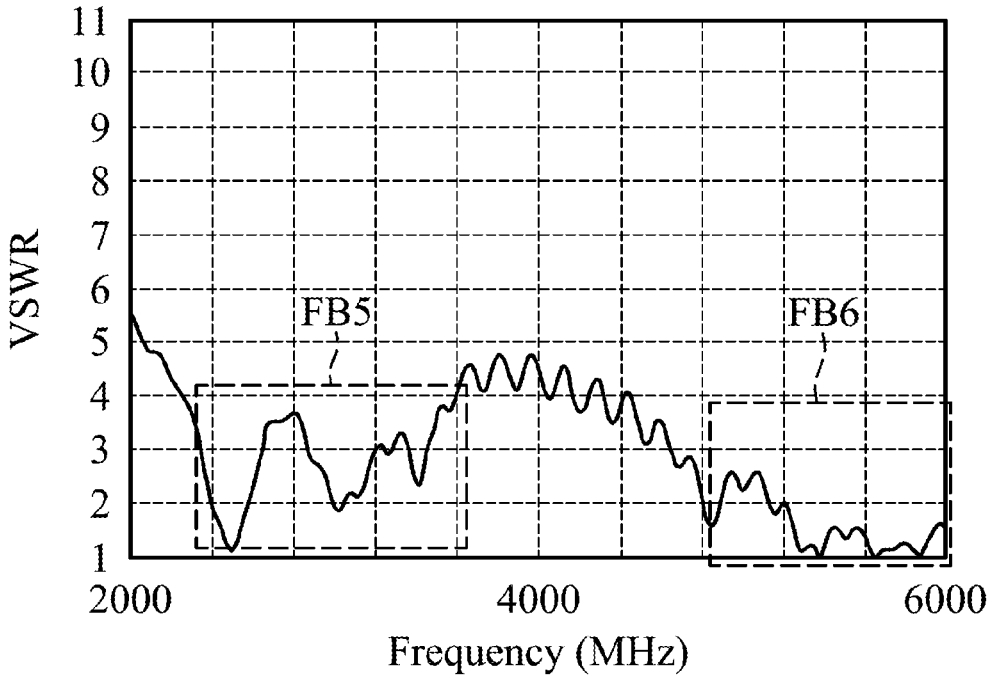
FIG. 7 is a diagram of a VSWR of an antenna structure according to an embodiment of the invention.

FIG. 7 is a diagram of a VSWR (Voltage Standing Wave Ratio) of the antenna structure 600 according to an embodiment of the invention. The vertical axis represents the operation frequency (MHz), and the horizontal axis represents the VSWR. According to the measurement of FIG. 7, the antenna structure 600 can cover a low-frequency band FB5 from about 2400 MHz to about 2484 MHz, and a high-frequency band FB6 from about 5150 MHz to about 5850 MHz. Therefore, the antenna structure 600 can support dual-band operations of WLAN (Wireless Local Area Network) 2.4 GHz/5 GHz.

Please refer to FIG. 6A, FIG. 6B, and FIG. 7 to understand the operation principle and element sizes of the antenna structure 600. The slot 115 of the metal piece 110 is excited to generate a fundamental resonant mode, thereby forming the low-frequency band FB5. The length L1 of the slot 115 of the metal piece 110 may be substantially equal to 0.5 wavelength ($\lambda/2$) of the low-frequency band FB5. The feeding radiation element 130 and the coupling radiation element 660 are excited to generate a resonant mode, thereby forming the high-frequency band FB6. The length L2 of the feeding radiation element 130 (the length L2 is from the positive electrode of the signal source 190 to the open end of the terminal rectangular widening portion 132, but it does not include the tuning branch 134) may be substantially equal to 0.25 wavelength ($\lambda/4$) of the high-frequency band FB6. The slot 115 of the metal piece 110 may be further excited to generate a higher-order resonant mode, thereby widening the high-frequency band FB6.

The embodiments of the invention propose a novel antenna structure. In comparison to the conventional antenna design, the proposed design has at least the advantages of: (1) being a planar antenna design, (2) being easy to manufacture a large amount of identical products, (3) covering all of the WLAN frequency bands, (4) minimizing the total size, (5) increasing the stability of the antenna, and (6) having a low manufacturing cost. Therefore, the proposed antenna structure is suitable for application in a variety of small-size mobile communication devices.

Note that the above element sizes, element parameters, element shapes, and frequency ranges are not limitations of the invention. An antenna designer can fine-tune these settings or values according to different requirements. It should be understood that the antenna structure of the invention is not limited to the configurations of FIGS. 1-7. The invention may merely include any one or more features of any one or more embodiments of FIGS. 1-7. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a metal piece, having a slot;

a dielectric substrate, having an upper surface and a lower surface, wherein the lower surface of the dielectric substrate is adjacent to the slot of the metal piece;

a feeding radiation element, disposed on the upper surface of the dielectric substrate, and coupled to a positive electrode of a signal source, wherein the feeding radiation element has a terminal rectangular widening portion having a width in a direction perpendicular to the length of the slot and a length in a direction parallel to the length of the slot, both the width and the length of the terminal rectangular widening portion are wider than the width of the other portion of the feeding radiation element, and the terminal rectangular widening portion of the feeding radiation element has a vertical projection which only partially overlaps the slot of the metal piece;

a grounding radiation element, disposed on the upper surface of the dielectric substrate, and coupled to a negative electrode of the signal source; and a grounding metal element, wherein the grounding radiation element is coupled through the grounding metal element to the metal piece.

2. The antenna structure as claimed in claim 1, wherein the antenna structure operates in a low-frequency band from about 2400 MHz to about 2484 MHz, and a high-frequency band from about 5150 MHz to about 5850 MHz.

3. The antenna structure as claimed in claim 2, wherein the slot of the metal piece is excited to generate a fundamental resonant mode, thereby forming the low-frequency band.

4. The antenna structure as claimed in claim 2, wherein a length of the slot of the metal piece is substantially equal to 0.5 wavelength of the low-frequency band.

5. The antenna structure as claimed in claim 2, wherein the feeding radiation element is excited to generate a resonant mode, thereby forming the high-frequency band, and wherein the slot of the metal piece is further excited to generate a higher-order resonant mode, thereby widening the high-frequency band.

6. The antenna structure as claimed in claim 2, wherein a length of the feeding radiation element is substantially equal to 0.25 wavelength of the high-frequency band.

7. The antenna structure as claimed in claim 1, wherein the metal piece is a metal housing of a mobile device.

8. The antenna structure as claimed in claim 1, wherein the dielectric substrate is an FR4 (Flame Retardant 4) substrate or an FPCB (Flexible Printed Circuit Board).

9. The antenna structure as claimed in claim 1, wherein the slot of the metal piece is substantially a straight-line shape.

10. The antenna structure as claimed in claim 1, wherein the feeding radiation element is substantially an L-shape or a T-shape.

11. The antenna structure as claimed in claim 1, wherein the grounding radiation element is substantially a straight-line shape.

12. The antenna structure as claimed in claim 1, wherein the grounding radiation element further comprises a protruding portion, and the protruding portion of the grounding radiation element has a vertical projection which at least partially overlaps the slot of the metal piece.

13. The antenna structure as claimed in claim 1, further comprising:

a coupling radiation element, disposed on the lower surface of the dielectric substrate, and coupled to the grounding radiation element.

14. The antenna structure as claimed in claim 13, wherein the coupling radiation element is coupled through one or more via elements to the grounding radiation element, and the via elements are formed in the dielectric substrate.

15. The antenna structure as claimed in claim 13, wherein the coupling radiation element is substantially a rectangular shape.

16. The antenna structure as claimed in claim 13, wherein the coupling radiation element has a vertical projection that at least partially overlaps the slot of the metal piece.

17. The antenna structure as claimed in claim 13, wherein the coupling radiation element is completely separate from the feeding radiation element.

* * * * *